US006085461A

United States Patent [19]

Brisson et al.

[11] Patent Number: 6,085,461

[45] Date of Patent: Jul. 11, 2000

[54] SUPPORT AND LIFTING MECHANISM FOR POTTED PLANTS

[76] Inventors: Joan Brisson, 8 Spring Lake Dr., Harrison, N.Y. 10604-2850; Gregory Brisson, 310 W. Lancaster Ave., Shillington, Pa. 19607

[21] Appl. No.: 09/090,956

[22] Filed: Jun. 5, 1998

[51] Int. Cl.[7] ..... A47G 7/02

[52] U.S. Cl. ..... 47/78

[58] Field of Search ..... 47/65.8, 67, 76, 47/78, 66.5; 294/149, 152, 157

[56] References Cited

U.S. PATENT DOCUMENTS

| | | | |
|---|---|---|---|
| D. 248,002 | 5/1978 | Staub et al. . | |
| 951,684 | 3/1910 | Gillespie . | |
| 1,810,236 | 8/1931 | Bender | 47/79 |
| 1,827,447 | 1/1931 | Wilmore | 47/76 |
| 3,775,903 | 12/1973 | Pike | 47/65.8 |
| 3,915,419 | 10/1975 | Brown et al. . | |
| 4,223,480 | 9/1980 | Welty | 47/78 |
| 5,025,590 | 6/1991 | Smith | 47/76 |
| 5,303,506 | 4/1994 | Weder et al. . | |
| 5,524,949 | 6/1996 | Mooney | 294/149 |

FOREIGN PATENT DOCUMENTS

| | | | |
|---|---|---|---|
| 20036163 | 12/1970 | France | 47/67 |
| 27 40 651 | 3/1979 | Germany | 47/65.8 |

OTHER PUBLICATIONS

Unknown, Greenhouse Plants Grown and Transplanted in Plastic Bags, Popular Science, p. 98, Apr. 1951.

Whitcomb, C.E., Containers vs. poly bags—Which are better?, American Nurseryman, vol. 57, p. 101–104, Jan. 1983.

*Primary Examiner*—Michael J. Carone
*Assistant Examiner*—Jeffrey L. Gellner
*Attorney, Agent, or Firm*—Dorsey & Whitney L.L.P.

[57] ABSTRACT

A flexible support and lifting mechanism is provided for potted plants. The support and lifting mechanism allows a potted plant, such as a potted plant contained in a nursery pot, to be safely and easily placed in or removed from a decorative planter. A mesh bag having a net-like structure encases the sides and the bottom of the nursery pot. The mesh bag includes handles formed from an upper portion of the net-like structure. The handles may also be separately formed and attached to the mesh bag, or the upper portion of the net-like structure may be used for grasping and lifting the mesh bag. The mesh bag is preferably made of a water and sunlight resistant material and may be colored to reduce its visibility in use.

2 Claims, 6 Drawing Sheets

SUPPORT AND LIFTING MECHANISM FOR POTTED PLANTS

BACKGROUND OF THE INVENTION

1. Field of the Invention

This invention relates to an apparatus for lifting and supporting a potted plant. In particular, the invention relates to a flexible apparatus that surrounds a potted plant and that can be used to easily remove the potted plant from a decorative planter.

2. Description of Related Art

Potted plants, including flowering bushes, trees and decorative plants are often displayed in decorative, expensive planters. The potted plants and their soil may be contained in a less expensive container such as a nursery pot, for example. The nursery pot may be constructed of plastic or clay materials, for example. The nursery pot is placed inside the decorative planter.

All potted plants require routine maintenance including soaking and draining, feeding, replacing soil and pruning. Many of these maintenance actions require that the potted plants be easily accessible, such as at a workbench. If the potted plants were left in their decorative planter, the decorative planter could be damaged during the plant maintenance actions and access to the potted plants would be restricted. Accordingly, for routine maintenance the nursery pot is often removed from the decorative planter. After the maintenance is complete, the nursery pot is replaced in the decorative planter.

FIG. 1 shows a conventional nursery pot 10. The nursery pot 10 is in the shape of a truncated cone. A shallow rim portion 11 surrounds the top portion of the nursery pot 10, and may be used for grasping and lifting the nursery pot 10. The nursery pot 10 includes a bottom 12 used to retain potted plants 14 and soil 15. The bottom 12 is provided with a drain hole 13 that allows excess water to drain from the soil 15, which helps prevent damage to the potted plants 14.

Removal of the nursery pot 10 from the decorative planter is often difficult because the nursery pot 10 may be heavy and of a large size. In addition, the nursery pot 10 may fit snugly inside the decorative planter making it difficult to grasp the nursery pot. The rim 11 may not provide a secure grip for removing the nursery pot 10 because of its lack of depth. Finally, the rim 11 may deteriorate and crack with age, making removal of the nursery pot 10 from the decorative planter difficult.

SUMMARY OF THE INVENTION

A mechanism is provided to easily remove a less expensive container such as a nursery pot from a more expensive, decorative planter. In an embodiment, a mesh bag in the form of an open cylinder encases the nursery pot leaving the top of the nursery pot accessible. The mesh bag and the nursery pot are then placed in the decorative planter. The mesh structure of the mesh bag can be securely grasped, thereby allowing the nursery pot to be easily lifted from the decorative planter. The mesh bag may also be provided with two or more opposed handles along the upper perimeter of the mesh bag. The handles are grasped for removal and loading of the nursery pot. When not in use, the handles are tucked away in the void between the nursery pot and the decorative planter. The mesh bag is preferably made of a water resistant and sunlight resistant material such as a man-made organic polymer, rubber or similar material. Alternately, the mesh bag may be constructed of natural fibers including burlap, rope and hemp, for example. The mesh bag may be made in a color that blends in with the color of the nursery pot, the soil and the potted plants. For example, the mesh bag may be dark green or black.

In an alternate embodiment, the lifting mechanism is a solid bag in the shape of an open cylinder. The lifting mechanism includes at least two opposed handles, formed from or connected to the upper perimeter of the solid bag. The handles may be folded away when the nursery pot is inside the decorative planter.

The solid bag includes a hole at the center of its bottom surface. The hole allows excess water collected in the nursery pot to drain from the nursery pot to prevent damage to the potted plants.

In yet another embodiment, a solid bag, in the form of an open cylinder, replaces the nursery pot so that the potted plants and the soil are housed within the solid bag. The solid bag according to this embodiment may be first used to line the decorative planter. The soil and the potted plants are then placed in the decorative planter but within the liner. The solid bag contains at least two opposed handles that are grasped to remove the solid bag from the decorative planter. The handles of the solid bag may be formed from the upper portion of the solid bag or may be separately formed and attached to the solid bag.

In an alternate arrangement, the solid bag may contain a number of perforations throughout the surface of the solid bag. The total area of the perforations is less than the remaining surface area of the solid bag.

In yet another embodiment, the nursery pot is provided with flexible, oppositely-opposed handles. The handles are preferably attached to the nursery pot using holes provided in the rim area of the nursery pot. The handles may be tucked away when the nursery pot is inside the decorative planter.

These and other embodiments will become apparent from a reading of the following detailed description taken in conjunction with the drawings.

BRIEF DESCRIPTION OF THE DRAWINGS

The invention will be described in detail with reference to the following drawings, wherein like reference numerals refer to like elements and wherein.

DETAILED DESCRIPTION OF PREFERRED EMBODIMENTS

Figure 1:
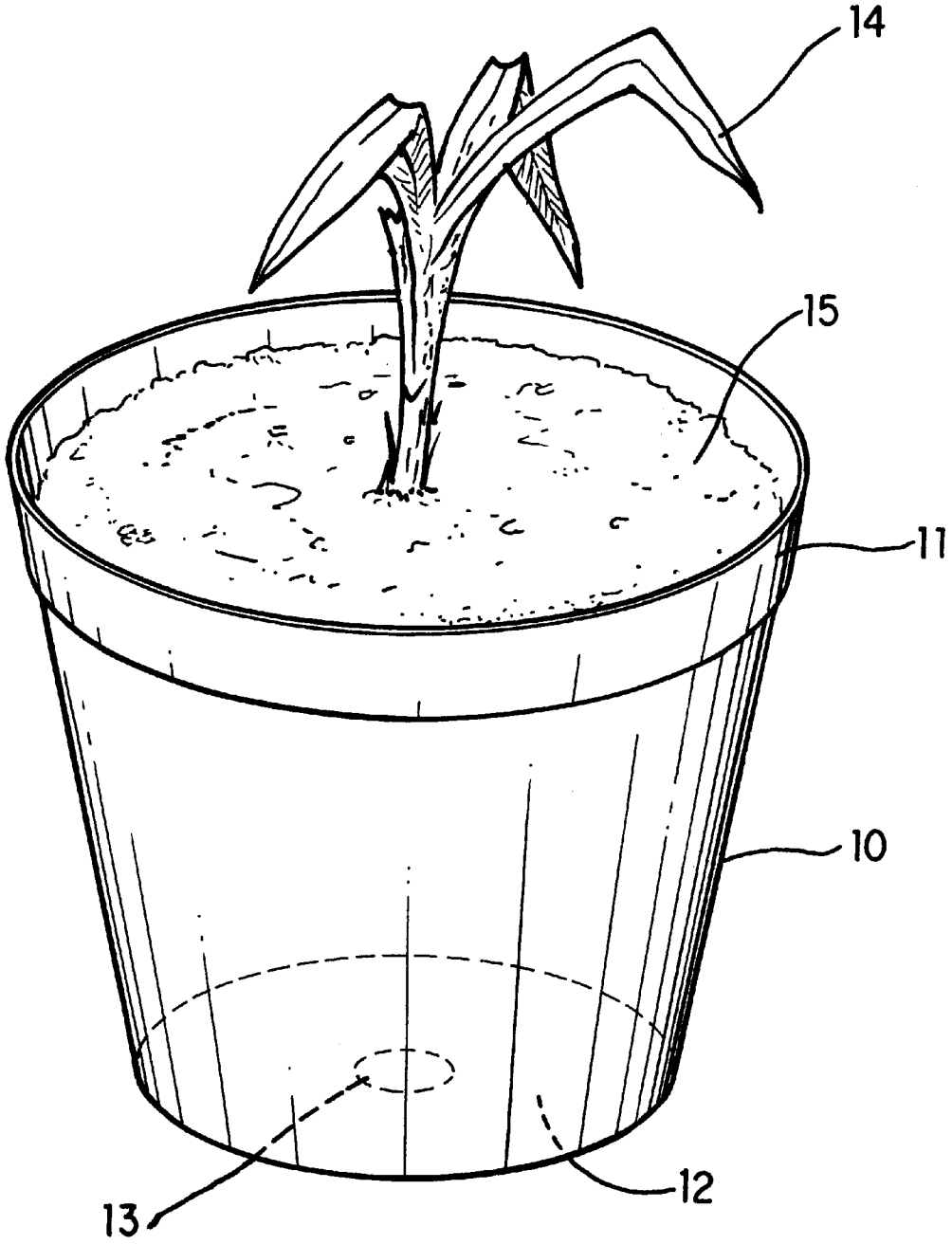
FIG. 1 PRIOR ART
FIG. 1 illustrates a conventional nursery pot.
Figure 2:
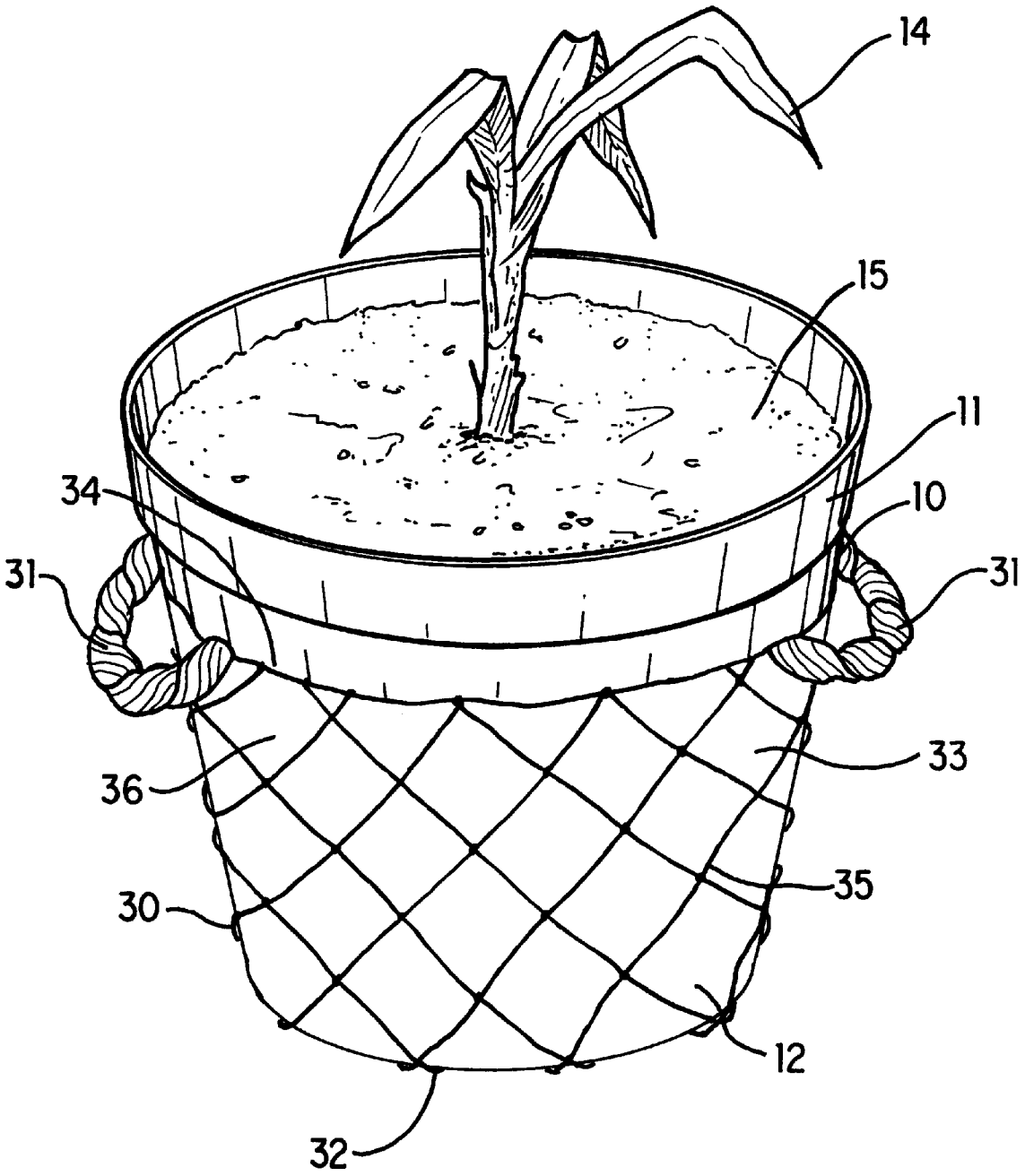
FIG. 2 illustrates a mesh bag according to the invention.

FIG. 2 shows a potted plant support and lifting mechanism according to an embodiment of the invention. In FIG. 2, a nursery pot 10 is shown partly removed from a mesh bag 30. The nursery pot 10 is in the shape of a truncated cone. An upper portion of the nursery pot contains a rim portion 11 that may be used to grasp the nursery pot 10. The nursery pot 10 contains soil 15 and one or more potted plants 14. The discussion that follows refers to use of the support and lifting mechanisms with the nursery pot. However, the support and lifting mechanisms described below may be used with any potted plant container.

The mesh bag 30 is generally cylindrical, or bag-like, in shape with handles 31, a bottom portion 32 and one or more openings 33 in a surface 36. Alternately, the mesh bag 30 may be conical, generally conforming to the shape of the nursery pot 10. To provide a structure for supporting the weight of the nursery pot 20, the mesh bag 30 includes strands 35 of a flexible material that are overlapped so as to intersect in an approximately perpendicular fashion, and that are fixed together at the point of intersection. The strands 35 are alternated and overlaid in a net-like fashion to form the surface 36 of the mesh bag 30.

The mesh bag 30 has a top opening 34 sized and shaped so that the nursery pot 10 may be inserted into the mesh bag 30. The mesh bag 30 includes the opposed handles 31 attached at the periphery of the upper edge of the mesh bag 30. The handles 31 may be formed as a continuation of the same strands 35 that are used to form the surface 36 of the mesh bag 30. Alternately, the handles 31 may be constructed of the same material as the strands 35 used to create the surface 36 of the mesh bag 30 and then may be separately attached to the mesh bag 30. Finally, the handles 31 may be constructed of a material other than that used to form the surface 36 of the mesh bag 30 and then separately attached to the mesh bag 30. The handles 31 are attached in a manner that allows them to be folded along an outer side of the surface 36 of the mesh bag 30.

When the nursery pot 10 is fully inserted in the mesh bag 30, the bottom 12 of the nursery pot 10 rests against and is supported by the bottom portion 32 of the mesh bag 30. Therefore, the nursery pot 10 may be raised and lowered using the handles 31, and the nursery pot 10 is fully supported by the mesh bag 30. The mesh bag 30 is also made of a flexible material, which will be described later, such that when the handles 31 are used to lift the mesh bag 30 and the nursery pot 10, the surface 36 of the mesh bag 30 tightens against the surface of the nursery pot 10, further securing the nursery pot 10 in the mesh bag 30.

The handles 31 and the mesh bag 30 are preferably made from the same material, which may be a man-made organic polymer, rubber, or synthetic cloth. The materials used to construct the mesh bag 30 are preferably water and sunlight resistant. The materials may also be chosen so that they will not stretch significantly when the mesh bag 30 is used to lift the nursery pot 10. The strands 35 may be circular in cross-section and of a small diameter to reduce their visibility. The mesh bag 30 is shown in FIG. 2 having an open weave pattern of fiber-like material. The size of the openings in the mesh bag 30 can range from as little as 0.1 inches and as large as 5 inches, for example. Other size mesh openings can be used according to the size of the nursery pot 10.

Figure 3:
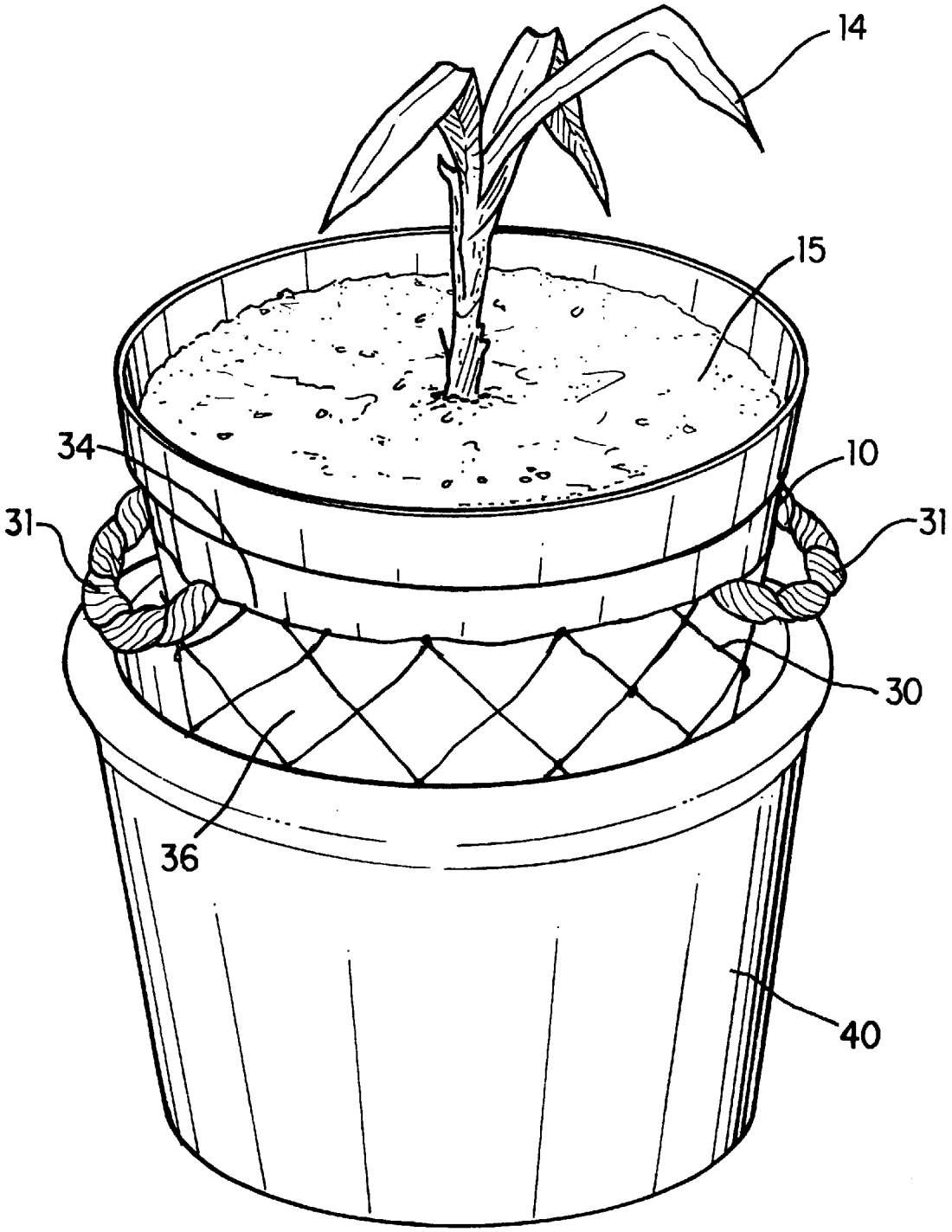
FIG. 3 illustrates the mesh bag of FIG. 2 partly inserted into a decorative planter.

FIG. 3 shows the nursery pot 10 and the mesh bag 30 partly inserted in a decorative planter 40. The decorative planter 40 may be an expensive or valuable planter. When the nursery pot 10 and the mesh bag 30 are fully inserted in the decorative planter 40, the handles 31 may be folded away along the surface 36 of the mesh bag 30 so as to limit their visibility. To further limit the visibility of the handles 31 and the mesh bag 30, both may be colored a dark green or black so as to blend in with the potted plants 14 and the soil 15.

In an alternate arrangement, the mesh bag 30 does not include the handles 31. In this arrangement, the top of the mesh bag 30 extends above the top of the nursery pot 10. To lift the mesh bag 30 and the nursery pot 10, a user first grasps the mesh bag material near the upper periphery of the mesh bag 30. The user may twist the mesh bag material, causing the mesh bag 30 to constrict against the outer surface of the nursery pot 10. The user can then safely and easily lower or raise the mesh bag 30 and the nursery pot 10 into or out of the decorative planter 40. The extended top portion of the mesh bag 30 can be folded down along the sides of the nursery pot 10 when the mesh bag 30 and the nursery pot 10 are in the decorative planter, thereby reducing the visibility of the mesh bag 30.

Figure 4:
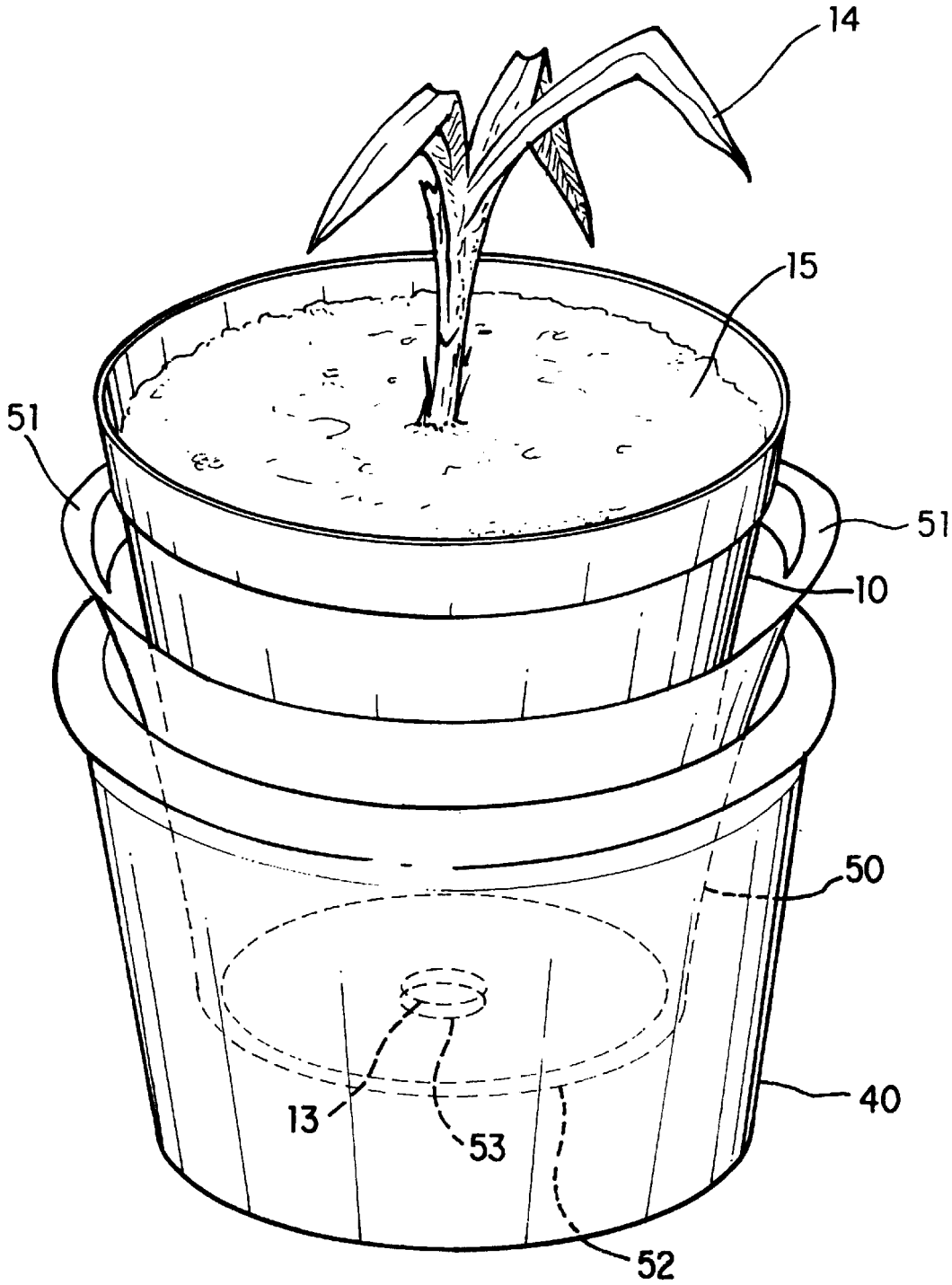
FIG. 4 illustrates a solid bag according to the invention.

FIG. 4 shows another embodiment of the potted plant support and lifting mechanism. In FIG. 4, a solid bag 50 is used to support the nursery pot 10 and to place and remove the nursery pot 10 from the decorative planter 40. The solid bag 50 is generally cylindrical in shape with a bottom portion 52. The bottom portion 52 includes a hole 53 that allows excess water contained in the nursery pot 10 to drain out, thereby preventing damage to the potted plants 14. The solid bag 50 also includes opposed handles 51 that are used to lift the solid bag 50 when the nursery pot 10 is contained therein.

The handles 51 may be folded along the outer surface of the solid bag 50, thereby making the handles 51 less visible when the nursery pot 10 and the solid bag 50 are in the decorative planter 40. In addition, the handles 51 and the solid bag 50 may be colored a dark green or black to blend in with the potted plants 15.

The solid bag 50 is preferably formed from a water proof and sunlight resistant material such as a man-made organic polymer, rubber or synthetic cloth. The material is of a thickness sufficient enough to prevent excessive stretching when supporting the nursery pot 10.

The solid bag 50 may also be provided with perforations (not shown) approximately evenly spaced across the surface of the solid bag 50. The total area of the perforations is less than the remaining surface area of the solid bag 40.

Figure 5:
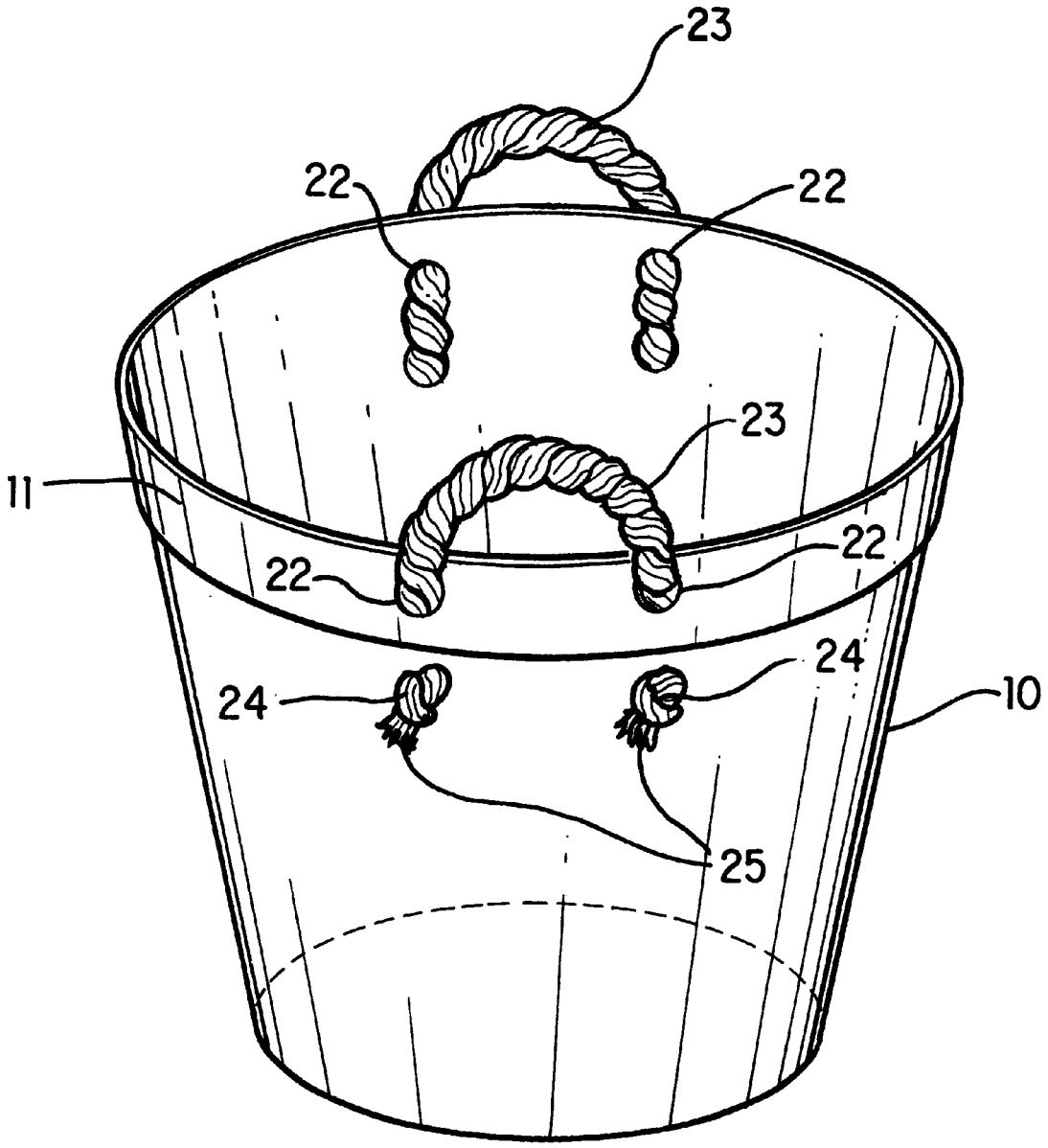
FIG. 5 illustrates a nursery pot with handles according to the invention.

FIG. 5 shows another embodiment for a mechanism for lifting potted plants. In FIG. 5, the nursery pot 10 includes holes 22 drilled along the rim 11, in oppositely-opposed locations. Handles 23 are then attached to the nursery pot 10 using the holes 22. The handles are prevented from coming out by knots 24 formed at ends 25 of the handles 23. The handles 23 may be any sturdy material such as a man-made organic polymer, synthetic cloth, hemp, or rope. The handles 23 may be folded away when the nursery pot 10 is not being raised or lowered. Alternately, the handles 23 may be pushed flush against a top portion of the rim 11.

Figure 6:
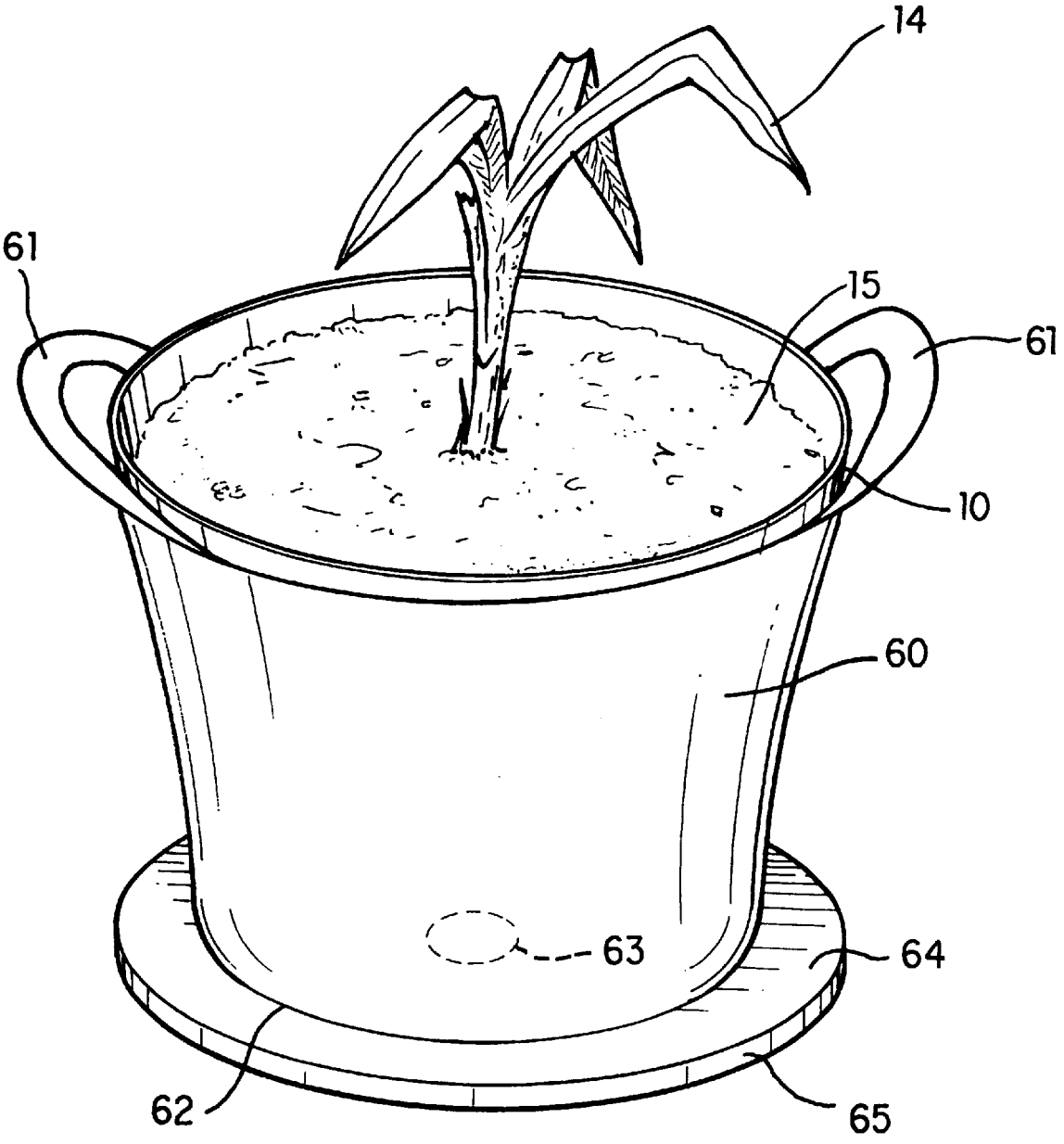
FIG. 6 shows a solid bag used as a liner for the decorative planter.

FIG. 6 shows yet another embodiment of a mechanism for supporting and lifting a potted plant. In FIG. 6, a liner 60 with pot 10 contains soil 15 and one or more plants 14. The liner 60 is generally cylindrically shaped and includes a bottom portion 62 and handles 61. The bottom portion 62 is provided with a hole 63 for draining excess water from the soil 15. Attached to the bottom portion 62 is a protective plate 64. The protective plate 64 is circular and flat and contains a rim or edge 65 around the periphery of the flat, circular protective plate 64. The protective plate 64 catches excess water or soil that drains from the liner 60. The protective plate 64 has a diameter approximately equal to that of the liner 60.

The handles 61 are shown formed from the same material as that used to form the liner 60. Alternately, the handles 61 may be separately formed and attached to the liner 60. Using the handles 61, the liner 60 containing the soil 15 and the plants 14 can be safely and easily lowered into or removed from the decorative planter 40.

The liner 60 is preferably made from a water resistant and sunlight resistant material such as a man-made organic polymer, rubber, synthetic cloth or similar material. The protective plate is preferably made from a hard plastic material. The liner 60, including the handles 61, may be colored dark green or black to blend in with the soil and the plants. The handles 61 are flexible and can be folded down along the side of the liner 60 to reduce their visibility when the liner 60 is placed inside the decorative planter 40.

The invention has been described with reference to the preferred embodiments thereof, which are illustrative and not limiting. Various changes may be made without departing from the spirit and scope of the invention as defined in the appended claims.

What is claimed is:

1. In combination, a pot, a plant, and an apparatus for lifting and supporting one or more potted plants, wherein the apparatus comprises:

a bag-like support structure having a bottom, sides, an upper end, and an object opening extending through the upper end, the object opening sized to accommodate the one or more potted plants, wherein the support structure is capable of covering the bottom and a substantial portion of the sides of the one or more potted plants;

one or more openings located in the bottom of the support structure, the one or more openings allowing the water to drain from the one or more potted plants;

a lifting mechanism at the upper end of the support structure, the lifting mechanism sized to be gripped by human hands, wherein when the lifting mechanism is grasped and pulled, the support structure constricts around the sides and the bottom of the one or more potted plants, thereby supporting the one or more potted plants during removal from or placement in a decorative planter; and a bottom protective plate attached to the bottom of the support structure, the protective plate including a circular flat area having a diameter essentially equal to a diameter of the support structure and a raised edge formed around a periphery of the circular flat area, the raised edge and the flat area accommodating excess soil and water from the one or more potted plants.

2. In combination, a pot, a plant, and an apparatus for lifting and supporting one or more potted plants, wherein the apparatus comprises:

a bag-like support structure having a bottom, sides, an upper end, and an object opening extending through the upper end, the object opening sized to accommodate the one or more potted plants, wherein the support structure is capable of covering the bottom and a substantial portion of the sides of the one or more potted plants, wherein the support structure comprises a solid material chosen from the group consisting of a man-made organic polymer, a rubber, a synthetic cloth and a combination thereof and wherein the support structure is colored a dark green or a black to blend in with the one or more potted plants;

one or more openings located in the bottom of the support structure, the one or more openings allowing the water to drain from the one or more potted plants, wherein the one or more openings are generally circular in cross-section and extend approximately equally over the surface of the support structure, the total area of the perforations being less than the surface area of the remaining solid material of the support structure;

a lifting mechanism at the upper end of the support structure, the lifting mechanism sized to be gripped by human hands, wherein when the lifting mechanism is grasped and pulled, the support structure constricts around the sides and the bottom of the one or more potted plants, thereby supporting the one or more potted plants during removal from or placement in a decorative planter.

* * * * *